US009784434B2

(12) United States Patent
Watanabe et al.

(10) Patent No.: US 9,784,434 B2
(45) Date of Patent: Oct. 10, 2017

(54) LIGHTING DEVICE AND LIGHTING FIXTURE

(71) Applicant: NICHIA CORPORATION, Anan-shi, Tokushima (JP)

(72) Inventors: Kazunori Watanabe, Yokohama (JP); Masaru Kato, Sagamihara (JP)

(73) Assignee: Nichia Corporation, Anan-shi (JP)

( * ) Notice: Subject to any disclaimer, the term of this patent is extended or adjusted under 35 U.S.C. 154(b) by 0 days.

(21) Appl. No.: 14/867,121

(22) Filed: Sep. 28, 2015

(65) Prior Publication Data

US 2016/0091170 A1 Mar. 31, 2016

(30) Foreign Application Priority Data

Sep. 30, 2014 (JP) ..... 2014-202190

(51) Int. Cl.
*F21V 7/06* (2006.01)
*F21V 7/04* (2006.01)
(Continued)

(52) U.S. Cl.
CPC ..... *F21V 7/04* (2013.01); *F21V 7/0008* (2013.01); *F21V 7/06* (2013.01); *F21V 7/0066* (2013.01);
(Continued)

(58) Field of Classification Search
CPC ..... F21V 7/0083; F21V 7/0066; F21V 7/04; F21V 7/06; F21V 7/09; F21V 7/00; F21V 7/0033; F21Y 2101/00; F21Y 2115/10; F21Y 2113/13; F21Y 2113/00; F21Y 2103/10; F21Y 2105/10; F21W 2131/202;
(Continued)

(56) References Cited

U.S. PATENT DOCUMENTS 2,676,312 A * 4/1954 Dillon ..... F21V 9/08 340/815.56
6,572,234 B1 * 6/2003 Maier ..... F21V 7/09 362/20
(Continued)

FOREIGN PATENT DOCUMENTS

GB 686620 * 10/1950
GB 686620 A 1/1953
(Continued)

OTHER PUBLICATIONS

Extended European Search Report of the corresponding European Patent Application No. 15187341.1, dated Dec. 8, 2015.

*Primary Examiner* — Hargobind S Sawhney
(74) *Attorney, Agent, or Firm* — Global IP Counselors, LLP

(57) ABSTRACT

A lighting device, having: a first light irradiation unit including a first concave reflecting mirror and a first light source provided within the first concave reflecting mirror; and a second light irradiation unit that has a second concave reflecting mirror that is smaller than the first concave reflecting mirror and a second light source provided within the second concave reflecting mirror, the second light irradiation unit being disposed more to the light irradiation direction side than the first light source, and being disposed so that the optical axes of the first concave reflecting mirror and the second concave reflecting mirror are the same.

15 Claims, 6 Drawing Sheets

(51) Int. Cl.

| | |
|---|---|
| *F21V 7/00* | (2006.01) |
| *F21W 131/205* | (2006.01) |
| *F21Y 115/10* | (2016.01) |
| *F21Y 107/60* | (2016.01) |
| *F21Y 113/13* | (2016.01) |

(52) U.S. Cl.
CPC .... *F21W 2131/205* (2013.01); *F21Y 2107/60* (2016.08); *F21Y 2113/13* (2016.08); *F21Y 2115/10* (2016.08)

(58) Field of Classification Search
CPC ..... F21W 2131/205; F21K 9/68; F21L 4/027; G02B 19/0066; G02B 27/30; G02B 5/10; H01L 33/60
See application file for complete search history.

(56) References Cited

U.S. PATENT DOCUMENTS

| | | | | |
|---|---|---|---|---|
| 7,431,486 | B2 | 10/2008 | Bloemen et al. | |
| 7,441,923 | B2 * | 10/2008 | Hunerbein | F21V 21/40 323/905 |
| 7,677,760 | B2 | 3/2010 | Simon | |
| 9,109,779 | B2 * | 8/2015 | Roth | F21V 7/0016 |
| 2004/0032739 | A1 * | 2/2004 | Johanson | F21V 17/007 362/304 |
| 2005/0259425 | A1 * | 11/2005 | Ovenshire | G09F 13/04 362/341 |
| 2006/0109650 | A1 | 5/2006 | Hunerbein et al. | |
| 2009/0015797 | A1 | 1/2009 | Hatanaka et al. | |
| 2009/0135606 | A1 * | 5/2009 | Young | F21V 7/0025 362/310 |
| 2010/0079995 | A1 | 4/2010 | Simon | |
| 2010/0165599 | A1 * | 7/2010 | Allen | F21V 7/0025 362/84 |
| 2010/0321933 | A1 | 12/2010 | Hatanaka et al. | |
| 2013/0200407 | A1 * | 8/2013 | Roth | F21V 7/0016 257/91 |

FOREIGN PATENT DOCUMENTS

| | | | |
|---|---|---|---|
| JP | 07-099343 | A | 4/1995 |
| JP | 09-116187 | A | 5/1997 |
| JP | 2002-360514 | A | 12/2002 |
| JP | 2006-318995 | A | 11/2006 |
| JP | 2010-182583 | A | 8/2010 |

* cited by examiner

LIGHTING DEVICE AND LIGHTING FIXTURE

CROSS-REFERENCE TO RELATED APPLICATIONS

This application claims priority to Japanese Patent Application No. 2014-202190 filed on Sep. 30, 2014. The entire disclosure of Japanese Patent Application No. 2014-202190 is hereby incorporated herein by reference.

BACKGROUND

1. Field of the Invention

The present invention relates to a lighting device and a lighting fixture having a plurality of light sources.

2. Description of Related Art

Lighting devices in which light emitting diodes or other such light emitting devices are used as the light source have been proposed. Also, lighting devices or lighting fixtures are known in which the light from a plurality of light sources is superposed on the irradiation target. For example, in a clinical use, lighting fixtures are used to illuminate the afflicted part of a patient (the irradiation target) by superposing light emitted from light sources on this site. This lighting fixture may be configured such that light irradiation units each comprising a light source and a reflecting mirror that reflects the light of this light source are arranged.

There has also been proposed a stacked type of light emitting diode device in which a plurality of the above-mentioned light irradiation units are installed on those optical axis (for examples Patent Literature JP2006-318995A). This light emitting diode device is formed by connecting a plurality of reflective light emitting diode units that are respectively formed by placing a light emitting diode and a dichroic mirror, by means of a connection member made of an electric insulating material.

With above mentioned conventional lighting devices or lighting fixtures, however, when the distance between the irradiation surface and the light emission component is changed, this may result in mismatched of the light beams obtained from each of the light emission units, which may be a problem in that the color of the light obtained at the irradiation surface is mismatched or uneven. Also, with the device in the above Patent Literature, units having the same size each other are stacked in the optical axis direction, so the size of the device may be enlarged in the depth direction.

SUMMARY

It is an object of the present invention to provide a lighting device and a lighting fixture that reduce unevenness in superposed light.

The lighting device of the present disclosure includes a first light irradiation unit including a first concave reflecting mirror and a first light source provided within the first concave reflecting mirror; and a second light irradiation unit including a second concave reflecting mirror that is smaller than the first concave reflecting mirror and a second light source provided within the second concave reflecting mirror, the second light irradiation unit being disposed more to the light irradiation direction side than the first light source, and being disposed so that the optical axes of the first concave reflecting mirror and the second concave reflecting mirror are the same.

The lighting fixture, includes a lighting fixture light source having a plurality of lighting devices above mentioned.

With the lighting fixture according to the present invention, the light fixture light sources having a first light irradiation unit and a second light irradiation unit which have different sizes each other arranged in size order facing toward the irradiation direction on the optical axis. With this configuration, light from the light fixture light sources can be blended at the same proportion at the irradiation surface, so color unevenness can be suppressed even when the distance of the irradiation surface is changed, so the color of light can be uniform. Therefore, with the lighting fixture according to the present invention, it can irradiate light that allows for easy determination particularly for checking vein, artery, or the like (the irradiation site) on a human patient even when the distance to the irradiation target is changed.

DETAILED DESCRIPTION OF THE INVENTION

Embodiments for implementing the lighting device and the lighting fixture of the present disclosure will be described below with reference to the accompanying drawings. In the following embodiment of the lighting device and the lighting fixture that embody the technological concept of the present invention are just examples, and unless otherwise specified, the constituent parts discussed in the embodiments are not intended to limit the scope of the present invention.

Further, constitutions described in examples and the embodiments can be employed in other examples and embodiments. The sizes and the arrangement relationships of the members in each of drawings are occasionally shown exaggerated for ease of explanation.

Configuration of Lighting Device

Figure 1:
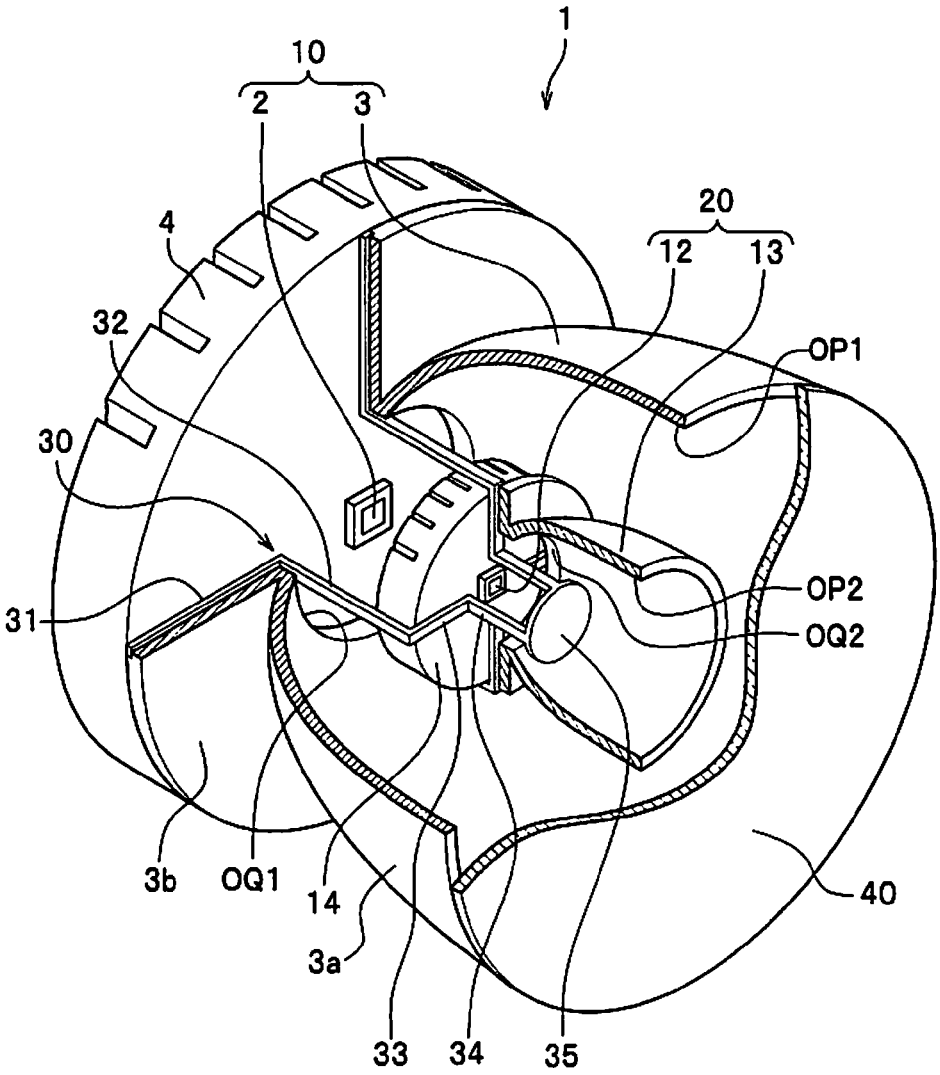
FIG. 1 is a simplified and partially cut away oblique view of lighting device according to an embodiment of the present invention.
Figure 2:
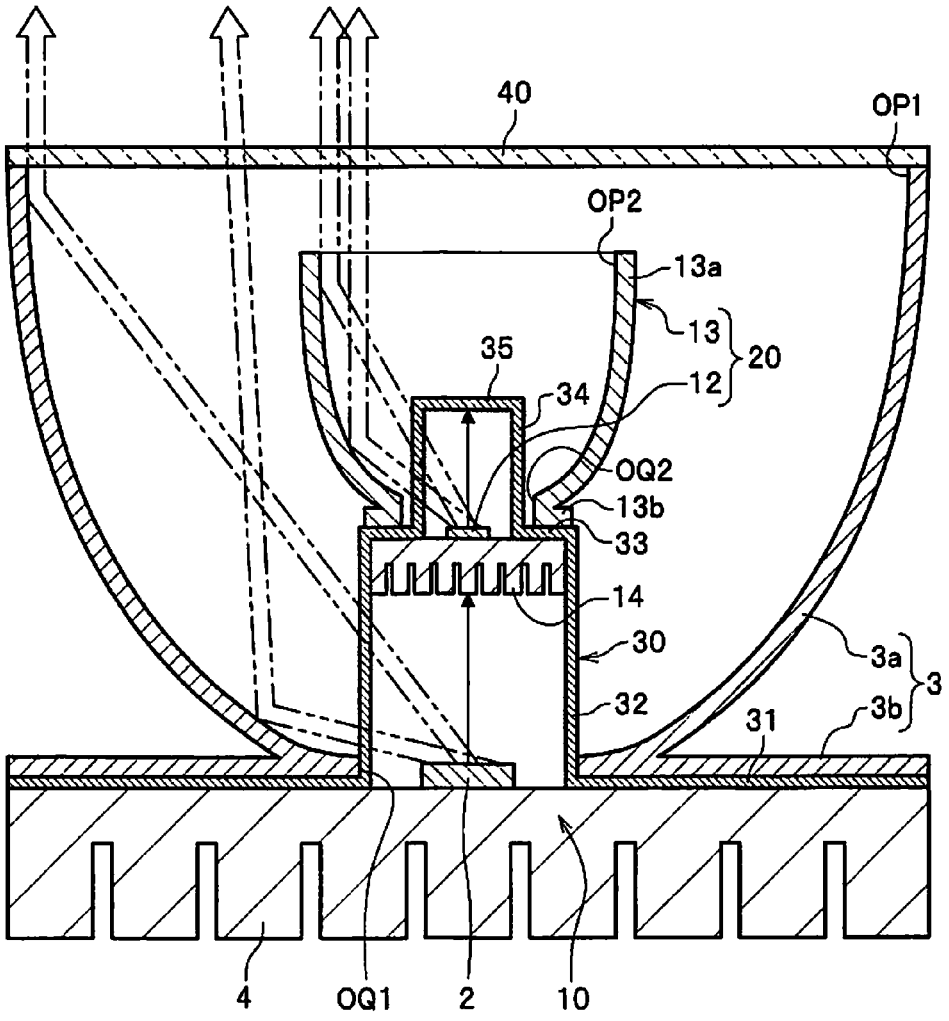
FIG. 2 is a cross section of the simplified configuration of the lighting device according to an embodiment of the present invention.

The configuration of a lighting device 1 according to this embodiment will be described through reference to FIGS. 1 and 2. The lighting device 1 includes a plurality of light irradiation units each includes a light source and a reflecting mirror, the plurality of light irradiation units are located as the optical axis of those are on the same axis and becoming smaller size toward the irradiation target. As shown in FIGS. 1 and 2, the lighting device 1 in this embodiment has a first light irradiation unit 10 and a second light irradiation unit 20. The lighting device 1 has a transmissive plate 40 detachably attached to a first irradiation opening OP1 of a first concave reflecting mirror 3 of the first light irradiation unit 10.

The first light irradiation unit 10 in this embodiment has a first light source 2, the first concave reflecting mirror 3 that reflects light from the first light source 2, and a first base 4 that supports the first light source 2 and the first concave reflecting mirror 3. The first light source 2 is located on the optical axis of the first concave reflecting mirror 3, and the first light source 2 is located at the focal position of the first concave reflecting mirror 3.

The first light source 2 is, for example, a light emitting device in which a semiconductor light emitting element is packaged. The light emitting element used in the light emitting device has a semiconductor layer composed of an n-type semiconductor layer, a p-type semiconductor layer, and a light emitting layer. The wavelength of the light emitting element provided to the light emitting device included this first light source 2 can be selected to match the desired emission color or the irradiation target. For instance, to obtain blue light (wavelength of 430 nm to 490 nm) or green light (wavelength of 490 nm to 570 nm), a nitride semiconductor ($In_XAl_YGa_{1-X-Y}N$ ($0 \leq X$, $0 \leq Y$, $X+Y \leq 1$), ZnSe, GaP, or the like can be used. To obtain red light (wavelength of 620 nm to 750 nm), GaAlAs, AlInGaP, or the like can be used. The composition, emission color, size, and so forth of the first light source 2 can be suitably selected as dictated by the intended application and purpose. For example, the first light source 2 may have just one light emitting element, or a plurality of light emitting elements arranged on a substrate to create a chip-on-board configuration.

Furthermore, the first light source 2 may have a pair of positive and negative electrodes on the opposite side from the emission surface, and a pair of positive and negative electrodes on the emission surface and on the opposite side. In the case that light emitting element the first light source 2 is mounted in flip-chip manner, it is preferable that either no substrate is provided above the semiconductor layer, or a sapphire or other such light-transmissive substrate is provided, so that enough light can be extracted from the light emitting diode.

The light from the light emitting element may be extracted from the first light source 2 without changing its color, but a phosphor, quantum dots, or another such wavelength conversion member can be provided to absorb light from the light emitting element and convert it into light of another wavelength. This allows various colors to be obtained. For example, white light, incandescent white, amber color, or other such light that is suited to use for lighting can be easily obtained. Examples of the phosphor the include nitride-based phosphors or oxynitride-based phosphors activated mainly with lanthanoid elements such as europium or cerium, and more specifically, α or β-sialon phosphors activated with europium, various alkaline earth metal nitride silicate phosphors, alkaline earth metal halogen apatite phosphors mainly activated with lanthanoid such as europium or transition metal such as manganese, alkaline earth halo-silicate phosphors, alkaline earth metal silicate phosphors, alkaline earth metal borate halogen phosphors, an alkaline earth metal aluminate salt phosphors, alkaline earth metal silicates salt phosphors, alkaline earth metal sulfides phosphors, alkaline earth metal thiogallate phosphors, alkaline earth metal nitride silicate phosphors, germanate salt phosphors, rare earth aluminates phosphorsmainly activated with lanthanoid elements such as cerium, rare earth silicates phosphors, or organic substance and organic complexes which are mainly activated with lanthanoid element such as europium.

It is particularly favorable to use a YAG phosphor (a yellow phosphor), KSF ($K_2SiF_6$:Mn) (a red phosphor), or a β-SiAlON phosphor or a LAG phosphor (a green phosphor), or the like. In addition to these, phosphors having similar performance and effects can also be used as needed. Just one phosphor can be used, or a mixture of two or more types can be used.

Specific examples of quantum dots that can be used include CdSe, core-shell $CdS_xSe_{1-x}$/ZnS, GaP, InP, AgInS, CuInS, and other such nano-size high-dispersion particles.

A wavelength conversion member that emits red light improves the visibility of blood vessels and the like by increasing the proportion of red light, so it can be used to advantage in a surgical lighting fixture.

The first base 4 in this embodiment supports the first light source 2 and the first concave reflecting mirror 3. This first base 4 here is formed so as to be used as a heat-sink that is capable to remove heat from the first light source 2. The first base 4 has a portion to connect the outside of the lighting device 1 and the first light source 2 electrically, and support the first concave reflecting mirror 3. As shown in FIGS. 1 and 2, the first base 4 is also configured to hold support legs 30 that support the second light irradiation unit 20. In one example of the first base 4, the first concave reflecting mirror 3 is connected to the first base 4 by screws, an adhesive agent, welding, or the like, and the support legs 30 are also connected to and supported by the first base 4. The first base 4 here is formed in a circle in a planer view, but its shape is not limited to this.

The first base 4 may include a connector, driver, and other such parts that allow power to be supplied from the outside to the first light source 2 and allow for the proper drive of the first light source 2 described above.

The first concave reflecting mirror 3 in this embodiment reflects the light from the first light source 2 toward the irradiation target. This first concave reflecting mirror 3 here has a first concave mirror component 3*a* that reflects light, and a first flange 3*b* that is provided at one end of the first concave mirror component 3*a*. In one example of the first concave reflecting mirror 3, the first concave mirror component 3*a* and the first flange 3*b* are formed integrally from sheet metal. Furthermore, the first concave reflecting mirror 3 has the first irradiation opening OP1 on the side where light is emitted, and a first proximal end opening OQ1 on the side where the first light source 2 is mounted, and is configured so that the first proximal end opening OQ1 is formed concentrically on the side of the first concave mirror component 3*a* that is opposite the first irradiation opening OP1.

The first concave reflecting mirror 3 is formed such that the first concave mirror component 3*a* has a parabolic surface, and is configured so that light emitted from the first light source 2 is reflected and irradiated as substantially parallel light. This first concave mirror component 3*a* is formed so as to have a mirror surface by subjecting the surface of its sheet metal to polishing or other such mechanical surface processing, sputtering or other such surface processing, or the like.

The first flange 3*b* in this embodiment is formed to match the shape of the first base 4. This first flange 3*b* may be used to connect the first concave reflecting mirror 3 to the first base 4, and may be large enough to allow connection by screws or the like. The first flange 3*b* in this embodiment has grooves formed on its side that is opposite the first base 4, so as to sandwich the support legs 30 between itself and the first base 4. Therefore, the first concave reflecting mirror 3 in this embodiment is fixed on the first base 4 with the support legs 30 by connecting the first flange 3*b* and the first base 4 by screws or the like in a state in which connecting leg components 31 of the support legs 30 are put into the grooves in the first flange 3*b*. Furthermore, in this embodiment the first flange 3*b* is formed in a band shape around the outside of the first base 4, but there are no particular restrictions on the size, shape, and so forth thereof so long as it can be supported on the first base 4. Also, the first flange 3*b* here is configured integrally with the first concave mirror component 3*a*, but it may be formed separately and then connected to the first concave mirror component 3*a*.

As shown in FIG. 1, the support legs 30 in this embodiment are used to support the second light irradiation unit 20. The support legs 30 here also serve to block directly incident light from the second light irradiation unit 20. More precisely, the support legs 30 have the connecting leg components 31 supported by the first base 4, upright leg components 32 formed at one end on the irradiation target side of the connecting leg components 31, horizontal leg components 33 formed at one end of these upright leg components 32, vertical leg components 34 formed at one end of these horizontal leg components 33, and a light blocker 35 (second light blocker) formed at one end of these vertical leg components 34.

The connecting leg components 31 are, for example, such that four linear members are disposed equidistantly at positions opposing the first base 4 in a planar view. These connecting leg components 31 are provided so that their ends are at locations where the upright leg components 32 can rise up through the first proximal end opening OQ1. There are no particular restrictions on the shape, size, length, and so forth of the connecting leg components 31, so as long as they can be supported on the first base 4. The connecting leg components 31 may have screw holes formed in them and they are removably attached to the first base 4 by screws.

The upright leg components 32 in this embodiment are used to dispose the second light irradiation unit 20 at the predetermined height. These upright leg components 32 are formed integrally and contiguous with the connecting leg components 31 by bending one end of the connecting leg components 31 at a specific angle (such as 90 degrees), for example. The upright leg components 32 are formed so as to rise up through the first proximal end opening OQ1 of the first light irradiation unit 10 toward the first irradiation opening OP1. Because the upright leg components 32 are disposed at positions where they may block part of the light from the first light source 2, they are preferably formed from strips or wires of metal or the like that are as thin as possible so that their surface area that blocks light will be smaller, but they will be strong enough to support the second light irradiation unit 20. Also, the upright leg components 32 here are configured so that the side surfaces of a second base 14 of the second light irradiation unit 20 is connected to and supported by the upper ends thereof.

The horizontal leg components 33 in this embodiment are formed integrally and contiguous with the upright leg components 32 by bending the upper ends of the upright leg components 32 at a specific angle (for example, 90 degrees). These horizontal leg components 33 are a connection portion used to form the vertical leg components 34 so that they rise up through a second proximal end opening OQ2 of the second light irradiation unit 20 toward a second irradiation opening OP2. The upper surface of the second base 14 of the second light irradiation unit 20 may be connected to these horizontal leg components 33.

The vertical leg components 34 in this embodiment are used to support the light blocker 35, which blocks directly incident light from a second light source 12. These vertical leg components 34 here are formed integrally and contiguous with the horizontal leg components 33 by bending one end of the horizontal leg components 33 at a specific angle (for example, 90 degrees). The vertical leg components 34 are formed so as to rise up through the second proximal end opening OQ2 of the second light irradiation unit 20 toward the second irradiation opening OP2. Because the vertical leg components 34 are disposed at positions where they block part of the light from the second light source 12, they are preferably formed from strips or wires of metal or the like that are as thin as possible so that their surface area that blocks light will be smaller, but they will be strong enough to support the light blocker 35.

The light blocker 35 in this embodiment is used to shield the irradiation target from directly incident light from the second light source 12. This light blacker 35 here is formed integrally and contiguous with one side of the vertical leg components 34. As an example, this light blocker 35 is formed from a circular piece of sheet metal. The surface area of the light blocker 35 is large enough to allow the directly incident light of the second light source 12 to be blocked.

The support legs 30 described above are formed, for example, by punching out sheet metal and bending it so as to integrate the vertical leg components 34, the horizontal leg components 33, the upright leg components 32, and the connecting leg components 31 and the light blocker 35. Accordingly, the support legs 30 including screw holes can be easily formed by punching out and bending the material.

As shown in FIGS. 1 and 2, the second light irradiation unit 20 in this embodiment is formed smaller than the first light irradiation unit 10, and the second light source 12 and a second concave reflecting mirror 13 are disposed along the optical axis so that their optical axis will be the same as the optical axis of the first light source 2 and the first concave reflecting mirror 3 of the first light irradiation unit 10. Also, the second concave reflecting mirror 13 of the second light irradiation unit 20 is disposed so that its opening direction coincides with the opening direction of the first concave reflecting mirror 3. Also, the second base 14 is located on the support legs 30 so that it will be at a position where it blocks directly incident light from the first light irradiation unit 10. Furthermore, the second light irradiation unit 20 is located on the support legs 30 so that it will be more to the inside than the open end of the first concave reflecting mirror 3. This second light irradiation unit 20 can be used to adjust the color temperature with respect to the first light irradiation unit 10.

The second light irradiation unit 20 has the second light source 12, the second concave reflecting mirror 13 that reflects the light from this second light source 12 toward the irradiation target, and the second base 14 that supports the second light source 12 and the second concave reflecting mirror 13. The second light irradiation unit 20 (the second base 14) is disposed more to the light irradiation direction side than the first light source 2, at a position opposite the first light source 2 of the first light irradiation unit 10, and here has the role of a light blocker (first light blacker) that blocks directly incident light going from the first light source 2 toward the irradiation target.

The second light source 12 and the second concave reflecting mirror 13 in this embodiment are formed in substantially equivalent shapes with respect to the shapes of the first light source 2 and the first concave reflecting mirror 3. The second light source 12 has substantially the same structure as the first light source 2 described above, and is configured to have a different emission color from that of the first light source 2. The second light source 12 is mounted on the second base 14, which can function as a heat sink, so as to be at the focal position of the second concave reflecting mirror 13. The size of the light irradiation surface portion of the second light source 12 is smaller than the light irradiation surface portion of the first light source 2. The second concave reflecting mirror 13 has a second concave mirror component 13*a* and a second flange 13*b*, and is smaller in size than the first concave reflecting mirror 3. The second concave mirror component 13*a* has a parabolic surface, just as is the first concave mirror component 3*a*. The second flange 13*b* has the same configuration as the first flange 3*b*, and only its size is different.

The second light irradiation unit 20 is configured so that the second light source 12 is provided to the second base 14 located in the second proximal end opening OQ2 of the second concave reflecting mirror 13 and irradiates light. The light is reflected by the second concave mirror component 13*a* and directed at the irradiation target from the second irradiation opening OP2. The directly incident light from the second light source 12 is blocked by the light blocker 35 disposed at location opposite the second light source 12.

The term "equivalent shape" in the present specification means the shapes of the first light irradiation unit 10 and the second light irradiation unit 20 are similar and the percentage of the correspondence of the relative intensity of light from the first light source 2 and the second light source 12 at the irradiation face (the irradiation target) is at least 90%, in the case where 100% means the values at full width at half maximum match. The term "substantially equivalent shape" means the shapes of the first light irradiation unit 10 and the second light irradiation unit 20 in the case where the above-mentioned value is at least 70%. Therefore, although it is preferable for the shapes, etc., to substantially match even though the sizes of the first concave reflecting mirror 3 and the second concave reflecting mirror 13 are different, the match does not need to be perfect. Also, it is preferable for the shape, etc., to match in the portions of the light irradiation surface where the first light source 2 and the second light source 12 are also in a different size relation, but the match does not need to be perfect.

Also, saying that the second concave reflecting mirror 13 is smaller than the first concave reflecting mirror 3 means, for example, that the diameter of the second irradiation opening OP2 is less than 60% of the diameter of the first irradiation opening OP1. In the case where efficiency of adjusting the color temperature and irradiation intensity is taken into account, 50% or less is preferable, and 40% or less is even better.

Further, in the case where the second light irradiation unit 20 is housed in the first light irradiation unit 10, the entire second light irradiation unit 20 is preferably located on the inside of the first irradiation opening OP1 of the first light irradiation unit 10, but part of it (such as the second base 14) can be located on the inside of the first irradiation opening OP1 of the first light irradiation unit 10, or more than half of it may be located on the inside of the first irradiation opening OP1. In the case that the entire second light irradiation unit 20 is not disposed on the inside of the first light irradiation unit 10, the shape of the transmissive plate 40 described below may be changed so that its middle protrudes out.

As shown in FIGS. 1 and 2, the transmissive plate 40 may be attached to the first irradiation opening OP1 of the first concave reflecting mirror 3 of the first light irradiation unit 10. This transmissive plate 40 can be formed from a transparent plastic, transparent glass, or another such material that will transmit the light from the first light source 2 and the second light source 12. This transmissive plate 40 may be used to protect a reflecting surface and the light sources 2 and 12 and to prevent the infiltration of dust from the outside.

Figure 3:
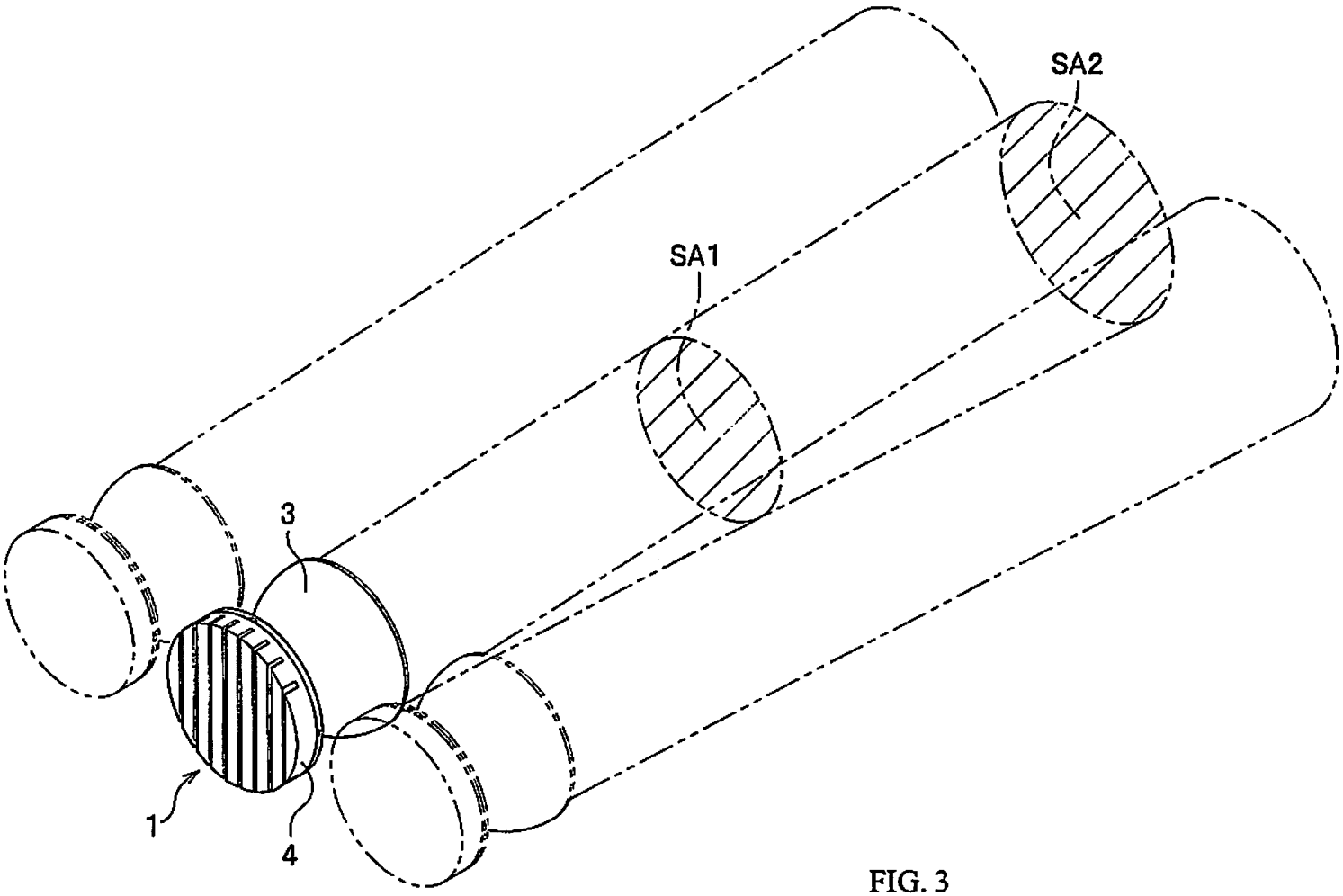
FIG. 3 is a simplified oblique view that shown how light is emitted from the lighting device according to an embodiment of the present invention.

As shown in FIG. 2, the lighting device 1 having the configuration described above can irradiate an irradiation target with light produced by the first light irradiation unit 10 and the second light irradiation unit 20, in a state in which color unevenness is unlikely to occur. Also, with the lighting device 1, since the second light irradiation unit 20 is disposed on the inside of the first light irradiation unit 10, the size in the depth direction can be kept to a minimum. As shown in FIG. 3, the lighting device 1 irradiates a first irradiation surface SA1 or a second irradiation surface SA2 with light, the light will be in the following state.

As shown in FIG. 2, with the lighting device 1, light emitted from the first light source 2 of the first light irradiation unit 10 and reflected to the first concave mirror component 3*a*, and light emitted from the second light source 12 of the second light irradiation unit 20 and reflected to the second concave mirror component 13*a* are directed at the irradiation target. When light is emitted from the lighting device 1, directly incident light from the first light source 2 of the first light irradiation unit 10 is blocked by the second base 14 of the second light irradiation unit 20, and directly incident light from the second light source 12 of the second light irradiation unit 20 is blocked by the light blocker 35.

Therefore, with the lighting device 1, as irradiation light, directly incident light which cause glare can be blocked, and the irradiation target can be irradiated with light that combines parallel light from the first concave mirror component 3*a* and the second concave mirror component 13*a*. Accordingly, with the lighting device 1, for example, a light emitting device that is capable to emit white light is used as the first light source 2, and a light emitting device that is capable to a different color light from that of the first light source 2, such as yellow light, yellowish white light, or the like, is used as the second light source 12, which allows the color of the light obtained from the lighting device 1 to be easily adjusted. For instance, the lighting device 1 can be adjusted so that the target is seen more clearly. Furthermore, the emission colors of the first light source 2 and the second light source 12 may be selected so that the color temperature of light from the first light source 2 is adjusted with light emitted from the second light source 12. For example, in the case that the color temperature of the second light source 12 is lower than the color temperature of the first light source 2, light with the desired color temperature can be obtained between the first light source 2 and the second light source 12 by adjusting the amount of light from the first light source 2 and the amount of light from the second light source 12.

Also, with the lighting device 1, even though the distance to the irradiation target is changed, since the first light irradiation unit 10 and the second light irradiation unit 20 are formed in substantially equivalent shapes and disposed on the same optical axis, the luminance distribution at the irradiation surface will be substantially the same, making it less likely that there will be color unevenness in the combined light.

This state in which color unevenness is unlikely to occur will be described through reference to FIGS. 3, 4A, 4B, 5A and 5B.

With the lighting device 1, the luminance in an absolute luminance cross section and the relative intensity in a relative luminance cross section are measured in the case where the distance to the first irradiation surface SA1 (a specific distance) shown in FIG. 3 was 0.7 m in the case where light was emitted, for example. With the lighting device 1, the values shown in FIG. 4A to FIG. 5B are measured, the first light irradiation unit 10 and the second light irradiation unit 20 are configured as follows, for example. The first light source 2 is a white (4500 K) LED light source with a 23.0 mm emission surface, and the second light source 12 is an amber (3800 K) LED light source with an 8.7 mm emission surface. The first concave reflecting mirror 3 of the first light irradiation unit 10 has a parabolic mirror surface in which a diameter of the first irradiation opening OP1 is a diameter of 160 mm, and a diameter of the first proximal end opening OQ1 is 60 mm. The concave reflecting mirror 13 of the second light irradiation unit 20 has a parabolic mirror surface in which a diameter of the second irradiation opening OP2 is 58 mm and a diameter of the second proximal end opening OQ2 is 36 mm.

Figure 4A:
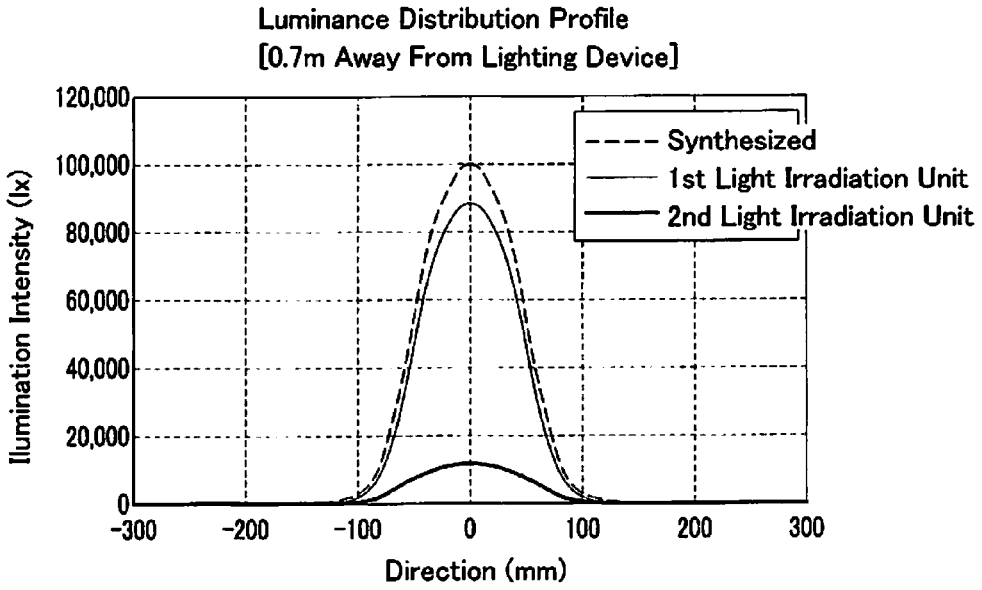
FIG. 4A is a luminance cross sectional graph of the absolute value in the case where light is emitted from the lighting device according to an embodiment at a position that is 0.7 m away from the lighting device.
Figure 4B:
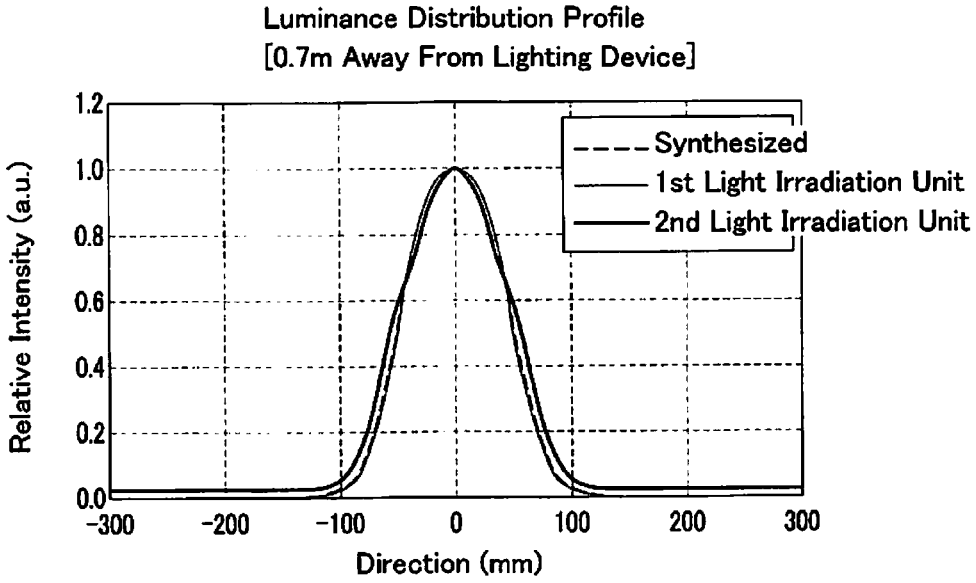
FIG. 4B is a luminance cross sectional graph of the relative value in the case where light is emitted from the lighting device according to an embodiment at a position that is 0.7 m away from the lighting device.

As shown in FIG. 4A, in an absolute luminance cross section, with an irradiation surface distribution cross section (circular distribution cross section), light is emitted over a range of about −100 to 100 mm, with the center of the emitted light at 0 mm. In an irradiation surface distribution cross section, the luminance with the first light irradiation unit 10 and the second light irradiation unit 20 is be substantially symmetrical about the center. Further, as shown in FIG. 4B, the relative intensity in a relative luminance cross section gives substantially matching values for the first light irradiation unit 10 and the second light irradiation unit 20. Thus, because the lighting device 1 has the first light irradiation unit 10 and the second light irradiation unit 20 that are configured as substantially equivalent shapes with the same optical axis, the light emitted from the lighting device 1 will relatively have substantially the same luminance distributions at the irradiation surface, so this can be considered a state in which color unevenness is unlikely to occur in the combined light.

As shown in FIG. 3, with the lighting device 1, the luminance in an absolute luminance cross section and the relative intensity in a relative luminance cross section are measured when the distance to the second irradiation surface SA2 (a specific distance) was 1.5 m in the case where light is emitted, for example.

Figure 5A:
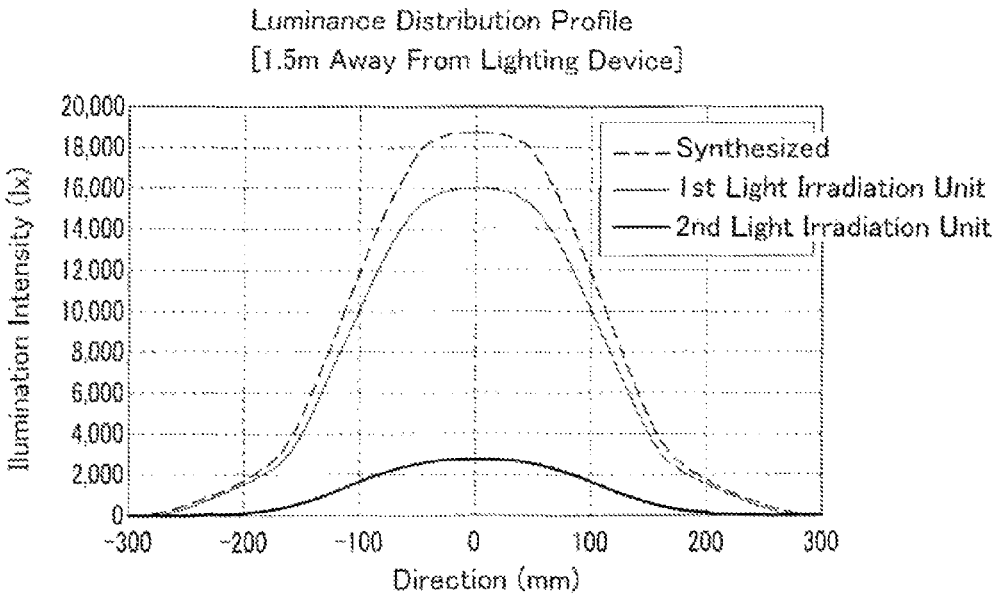
FIG. 5A is a luminance cross sectional graph of the absolute value in the case where light is emitted from the lighting device according to an embodiment at a position that is 1.5 m away from the lighting device.
Figure 5B:
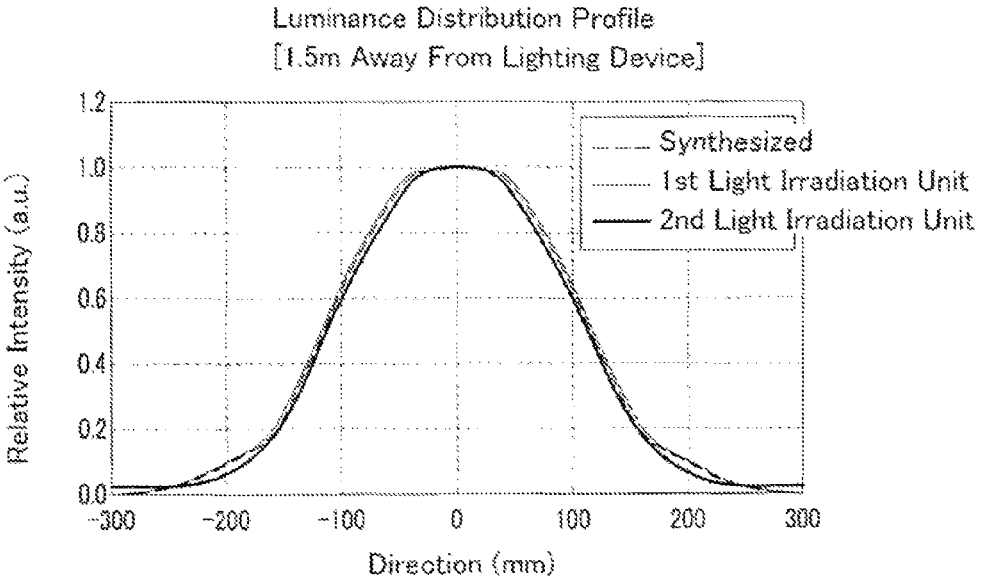
FIG. 5B is a luminance cross sectional graph of the relative value in the case where light is emitted from the lighting device according to an embodiment at a position that is 1.5 m away from the lighting device.

As shown in FIG. 5A, in an absolute luminance cross section, with an irradiation surface distribution cross section (circular distribution cross section), light is emitted over a range of about −200 to 200 mm, with the center of the emitted light at 0 mm. In an irradiation surface distribution cross section, the luminance with the first light irradiation unit 10 and the second light irradiation unit 20 is substantially symmetrical about the center. Further, as shown in FIG. 5B, the relative intensity in a relative luminance cross section gives substantially matching values for the first light irradiation unit 10 and the second light irradiation unit 20. Thus, because the lighting device 1 has the first light irradiation unit 10 and the second light irradiation unit 20 that are configured as substantially equivalent shapes with the same optical axis, the light emitted from the lighting device 1 will relatively have substantially the same luminance distributions at the irradiation surface even though the distance changes from 0.7 m to 1.5 m, so this can be considered a state in which color unevenness is unlikely to occur in the combined light.

As described above, the lighting device 1 is configured so that color unevenness will be unlikely to occur at the irradiation surface even when the position of the irradiation target is changed. Accordingly, with the lighting device 1, handling is easy, adjustment the first light source 2 and the second light source 12 may not be required in the case where the distance to the irradiation target is changed, and a state of uniform luminance distribution up to a preset irradiation target can be maintained even when the irradiation distance changes. Therefore, the lighting device 1 is suited to lighting fixtures used in the medical field, for example.

Figure 6:
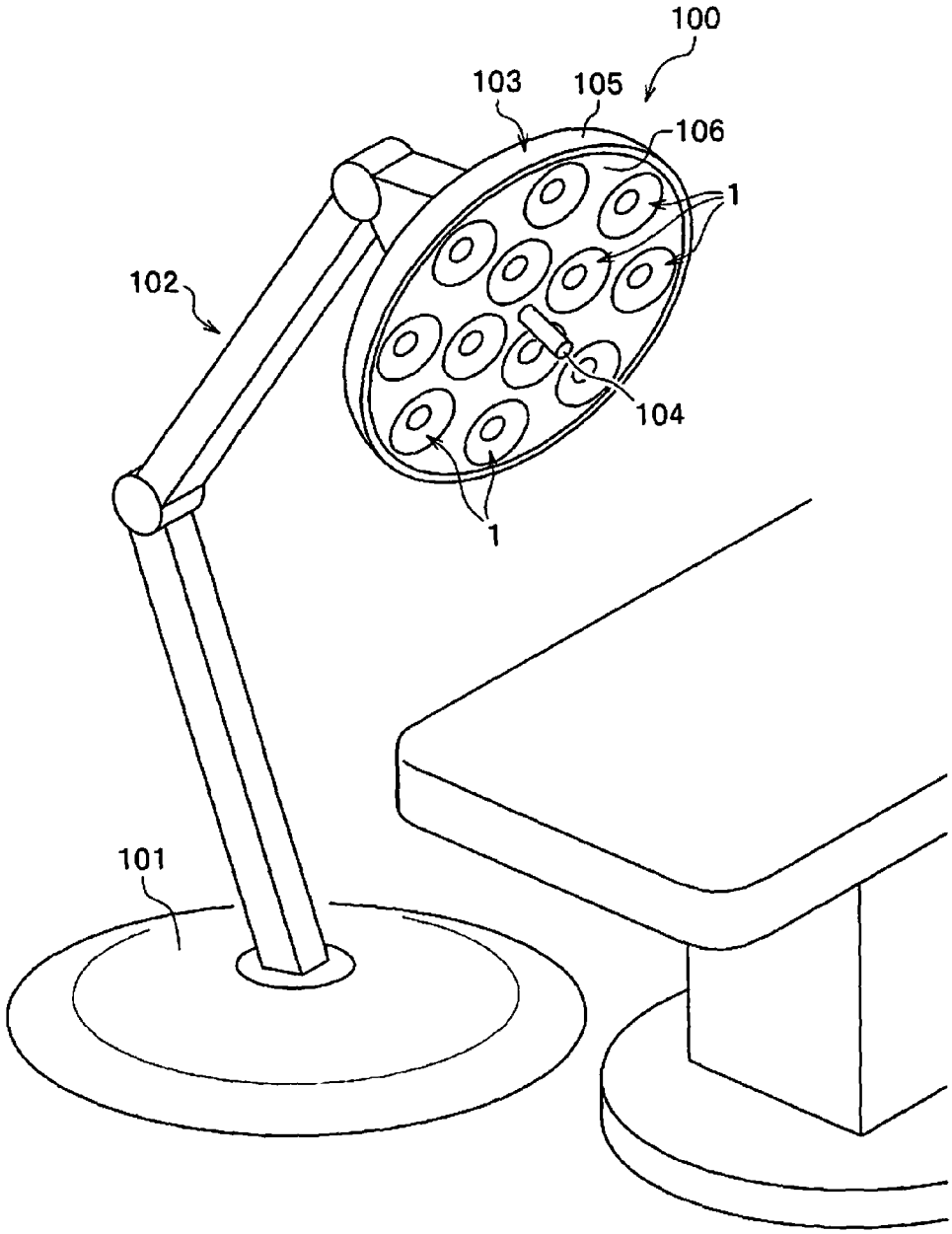
FIG. 6 is a simplified oblique view of the lighting fixture according to an embodiment of the present invention.

As shown in FIG. 6, a case of applying the lighting device 1 to a lighting fixture 100 will now be described.

As shown in FIG. 6, the lighting fixture 100 in this embodiment is applied to perform surgery or the like in a medical facility. With this lighting fixture 100, it may be necessary in the course of surgery to change the distance to the site on the patient (the irradiation target). In this case, it is necessary that color unevenness is unlikely to occur even when the lighting fixture 100 is moved from its preset position and the distance to the irradiation target is changed.

The lighting fixture 100 may be configured so that it can be moved to a position where light can be directed toward the irradiation target, and here it has a lighting fixture support base 101, a support arm 102 provided above this lighting fixture support base 101, a lighting fixture light source 103 provided to the distal end of this support arm 102, a handle bar 104 for adjusting the position of this lighting fixture light source 103, and a transmissive cover provided so as to protect the lighting fixture light source 103.

The lighting fixture light source 103 has a plurality of the lighting devices 1 described above arranged within a lighting fixture shade-like frame 105 via a spacer 106, for example. The lighting devices 1 may be spaced apart from one another, or may be disposed adjacent to one another. Also, the support arm 102 here is configured to have a rotation unit that changes the angle or direction at a plurality of joint positions in the lengthwise direction.

With the lighting fixture 100 described above, the lighting fixture support base 101 is disposed so that light irradiates a preset position, and the light from the lighting fixture light source 103 is emitted toward the irradiation target in a state in which the angle of the support arm 102 is set. The light emitted from the lighting fixture 100 becomes combined light at the position of the irradiation target, and the irradiation target is irradiated in a state in which color unevenness is unlikely to occur. Also, with the lighting fixture 100, in the case that the position of the lighting fixture light source 103 is changed, the handle bar 104 is pushed or pulled to move the portions that serve as the joints of the support arm 102, allowing adjustment that changes the position of the lighting fixture light source 103. Also, a lighting fixture 100 that casts no shadow on the irradiated site (called a shadow-less light, etc.) can be created by varying the angles of the light from a plurality of lighting devices.

Even when the distance to the irradiation target is changed from the preset position, the light emitted from the lighting fixture light source 103 will still have the same luminance distribution as shown in FIGS. 4A and 5A and in FIGS. 4B and 5B, so color unevenness will be unlikely to occur. Therefore, this is convenient for performing surgery, such as being able to easily find the position of a patient's vein or artery (examples of the irradiation target). With the lighting fixture 100, since the colors of the first light source 2 and the second light source 12 are different in the plurality of lighting devices 1 respectively.

As described above, with the lighting device 1 and the lighting fixture 100 disclosed herein, since the first light irradiation unit 10 and the second light irradiation unit 20 are mounted in substantially equivalent shapes on a single optical axis, color unevenness will be unlikely to occur in combined light since there is no change in the luminance distribution even though the distance to the irradiation target is changed, so the irradiation target can be properly illuminated.

With the lighting device 1 and the lighting fixture 100, the first concave mirror component 3*a* and the second concave mirror component 13*a* are described as being parabolic surfaces, but they may instead be pseudo-parabolic surfaces in which cross sectional shapes along the optical axis of a concave mirror are connected straight lines, for example. Also, the emission colors used by the first light source 2 and the second light source 12 may be any color other than white or yellow.

Also, in the case that the first light source 2 and the second light source 12 are positioned at a specific location of the first base 4 or the second base 14, they may be connected via solder, a connector, or an anisotropic conduction member. Furthermore, the first light source 2 and the second light source 12 may be configured to cover a transmissive member (such as a sealing resin, etc.). In the case that the transmissive member is provided, it may contain a phosphor, a colorant, a light diffuser, a filler, or the like in order to convert the wavelength or improve light extraction efficiency, as desired.

The first flange 3*b* described above is formed so as to be evenly contiguous with the outer periphery of the first base 4, but the first flange 3*b* may instead be formed so as to be intermittently contiguous with the first concave mirror component 3*a*, so that the connecting leg components 31 of the support legs 30 are exposed from the first flange 3*b*. Also, the second flange 13*b* described above is formed so as to be evenly contiguous with the outer periphery of the second base 14, but the second flange 13*b* may instead be formed so as to be intermittently contiguous with the second concave mirror component 13*a*, so that the horizontal leg components 33 of the support legs 30 are exposed from the second flange 13*b*.

Also, the angle of the upright leg components 32 may be set according to the outer peripheral shape of the second base 14, this angle can be greater than or less than 90 degrees to provide an inclination angle. Furthermore, an inclination angle may be provided to the vertical leg components 34 so that this angle is greater than or less than 90 degrees, depending on the size of the light blacker 35.

Further, screw holes may be formed in the upper ends of the upright leg components 32, so that the second base 14 of the second light irradiation unit 20 is supported by screws.

With the second light irradiation unit 20, a configuration described above is in which the light blocker 35 that blocked directly incident light is provided to the support legs 30, but the configuration may instead be such that a light blocking film or plate that blocks directly incident light of the second light source 12 is mounted in the center of the transmissive plate 40.

Also, the support legs 30 described above include four legs that reached the light blocker 35, but are not limited to this configuration, and may be three or two, etc.

Further, the first light blacker that blocks directly incident light of the first light irradiation unit 10 is not limited to a configuration in which it is also used for the second light irradiation unit 20 (or the second base 14), and may instead be constituted by a separate light blocking plate or other such member.

Moreover, the lighting device 1 described above has the first light irradiation unit 10 and the second light irradiation unit 20, but this is not the only option, and may have a third light irradiation unit that is smaller than the second light irradiation unit 20, in the same relation as that of the first light irradiation unit 10 and the second light irradiation unit 20, for example.

What is claimed is:

1. A lighting device comprising:

a first light irradiation unit including a first concave reflecting mirror and a first light source provided within the first concave reflecting mirror;

a second light irradiation unit including a second concave reflecting mirror that is smaller than the first concave reflecting mirror and a second light source provided within the second concave reflecting mirror, the second light irradiation unit being disposed more to the light irradiation direction side than the first light source, and being disposed so that the optical axes of the first concave reflecting mirror and the second concave reflecting mirror are the same; and a plurality of support legs fixedly disposed within the first concave reflecting mirror and supporting the second light irradiation unit so that an open end of the second concave reflecting mirror on the light irradiation direction side is disposed more to an inside than an open end of the first concave reflecting mirror on the light irradiation direction.

2. The lighting device according to claim 1, wherein the first concave reflecting mirror and the second concave reflecting mirrors have substantially similar shapes, and the first light source and the second light source have substantially similar shapes.

3. The lighting device according to claim 1, wherein the second light irradiation unit is disposed at a position opposite the first light source of the first light irradiation unit, and part of the light emitted from the first light source is blocked by the second light irradiation unit.

4. The lighting device according to claim 1, wherein the second light irradiation unit is configured to have a different emission color from that of the first light irradiation unit.

5. The lighting device according to claim 1, wherein the second light irradiation unit irradiates light to adjust the color temperature with respect to the first light irradiation unit.

6. The lighting device according to claim 1, wherein the first concave reflecting mirror has a first concave mirror component having a mirror surface.

7. The lighting device according to claim 6 wherein the first concave mirror component has a parabolic surface.

8. The lighting device according to claim 6, wherein the first concave mirror component has a pseudo-parabolic surface.

9. The lighting device according to claim 1, wherein the first concave reflecting mirror has a first irradiation opening, and a transmissive plate attached to the first irradiation opening.

10. The lighting device according to claim 1, wherein the first light source is located at a focal position of the first concave reflecting mirror.

11. The lighting device according to claim 1, wherein the entire second light irradiation unit is located on the inside of the first light irradiation unit.

12. A lighting fixture, comprising a lighting fixture light source in which a plurality of lighting devices according to claim 1 are mounted in a row.

13. The lighting device according to claim 1, wherein the first light source is a light emitting device including a light emitting element and a wavelength conversion member.

14. The lighting device according to claim 1, wherein each of the support legs further includes a leg component arranged in the second concave reflecting mirror.

15. The lighting device according to claim 14, further comprising a light blocker supported by the leg component of each of the support legs at a position on the light irradiation direction side of the second light source to block the light emitted from the second light source along an optical axis direction of the second light source.

* * * * *